US007021952B2

(12) United States Patent
Drescher

(10) Patent No.: US 7,021,952 B2
(45) Date of Patent: Apr. 4, 2006

(54) ELECTRICAL PLUG CONNECTOR

(75) Inventor: Thomas Drescher, Hueckeswagen (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/045,841

(22) Filed: Jan. 28, 2005

(65) Prior Publication Data

US 2005/0164550 A1 Jul. 28, 2005

(30) Foreign Application Priority Data

Jan. 28, 2004 (EP) ..... 04001838

(51) Int. Cl.
*H01R 13/52* (2006.01)

(52) U.S. Cl. ..... 439/282; 439/552; 439/548; 439/589

(58) Field of Classification Search ..... 439/281–282, 439/552, 548, 589
See application file for complete search history.

(56) References Cited

U.S. PATENT DOCUMENTS 4,810,208 A * 3/1989 Hayes et al. ..... 439/589
4,946,402 A * 8/1990 Fink et al. ..... 439/274
6,464,543 B1 * 10/2002 Suzuki ..... 439/736

FOREIGN PATENT DOCUMENTS

EP 0 330 436 8/1989
EP 0 895 312 2/1999

* cited by examiner

*Primary Examiner*—Truc Nguyen
(74) *Attorney, Agent, or Firm*—David P. Wood

(57) ABSTRACT

An electrical plug connector includes a housing having at least one receiver for an electrical contact, a second latching element which can be moved with respect to the housing from a pre-assembly position, in which the electrical contact can be inserted into the receiver, into an end position, in which the contact is secured in the receiver by the second latching arrangement, and a seal mounted on a spigot-like housing section. Considered in the plug-in direction, guide ribs for the seal are provided between the region of the spigot-like housing section designed to receive the seal and the second latching element adopting its pre-assembly position in order also to support the seal in the intermediate region in the event of a possible shift in the direction of the second latching element.

11 Claims, 3 Drawing Sheets

ELECTRICAL PLUG CONNECTOR

TECHNICAL FIELD

The invention relates to an electrical plug connector comprising a housing having at least one receiver for an electrical contact, a second latching element which can be moved with respect to the housing from a pre-assembly position, in which the electrical contact can be inserted into the receiver, into an end position, in which the contact is secured in the receiver by the second latching arrangement, and a seal mounted on a spigot-like housing section.

BACKGROUND OF THE INVENTION

Electrical plug connectors of this kind are generally known. As a rule, they can be plugged together with a complementary plug connector and serve for the electrical connection, and optionally also for the mechanical connection, of electrical apparatus such as cables and/or electrical units. They are in particular also used in motor vehicles.

It can, for example, occur during the transport or further processing of such an electrical plug connector that the housing seal slips down in the direction of the second latching element adopting its pre-assembly position and comes to rest at the second latching element. A corresponding shift of the seal is not visible at a first glance so that it is not noticed in every case during assembly. If, however, the plug connector is now fitted with electrical contacts and if the second latching element is subsequently moved into its end position, the risk exists that the seal is squashed, damaged or even destroyed, which is equivalent to a technical failure of the connector.

SUMMARY OF THE INVENTION

It is the underlying object of the invention to provide an improved plug connector of the initially named kind in which the aforesaid problem is eliminated in a manner which is as simple and as reliable as possible.

This object is satisfied in accordance with the invention in that, when considered in the plug-in direction, guide ribs for the seal are provided between the region of the spigot-like housing section designed to receive the seal and the second latching element adopting its pre-assembly position in order also to support the seal in the intermediate region in the event of a possible shift in the direction of the second latching element.

It is precluded in a simple and reliable manner on the basis of this design that a squashing of or damage to or even a destruction of the seal occurs in the event of a slipped housing seal on the movement into the end position. The system is self explanatory and the respective plug connectors can be handled without problem and in a simple manner. The respective fitter therefore does not have to make any considerations as to whether the housing seal has slipped or not since the system can be used without problem and reliably even when the seal has slipped.

The guide ribs are preferably distributed in the peripheral direction such that the seal is also kept at its pre-tensioned level in the intermediate range in the event of a possible shift. A collision with the second latching element moved into its end position can thus not occur at any time even in the critical intermediate region.

The guide ribs preferably extending in the plug-in direction are preferably provided at the housing or at the spigot-like housing section. In this case, the second latching element can be provided with cut-outs into which the guide ribs enter on a moving of the second latching element into the end position.

However, such an embodiment is generally also conceivable in which at least some of the guide ribs are associated with the second latching element, with the corresponding cut-outs being provided in the housing in this case. The guide ribs are, however, preferably provided at the housing.

As already mentioned, the second latching element can preferably be displaced between its pre-assembly position and its end position in the plug-in direction.

In a preferred practical embodiment, the seal extends around the spigot-like housing section. The housing seal can therefore in particular be ring-shaped.

The spigot-like housing section supporting the seal is advantageously arranged inside a peripheral housing collar. The spacing between the seal and the housing collar is expediently smaller than the wall thickness of a housing sleeve associated with a complementary plug connector so that said sleeve can be introduced into the region between the seal and the housing collar on the plugging together of the two connectors and the seal is compressed.

The plug connector can be provided as a plug-in part or as a receiver part of the respective plug connector system, with it preferably being designed as a plug-in part.

BRIEF DESCRIPTION OF THE DRAWINGS

The invention will be explained in more detail in the following with reference to an embodiment and to the drawing; there are shown in it.

DESCRIPTION OF THE PREFERRED EMBODIMENT

Figure 1:
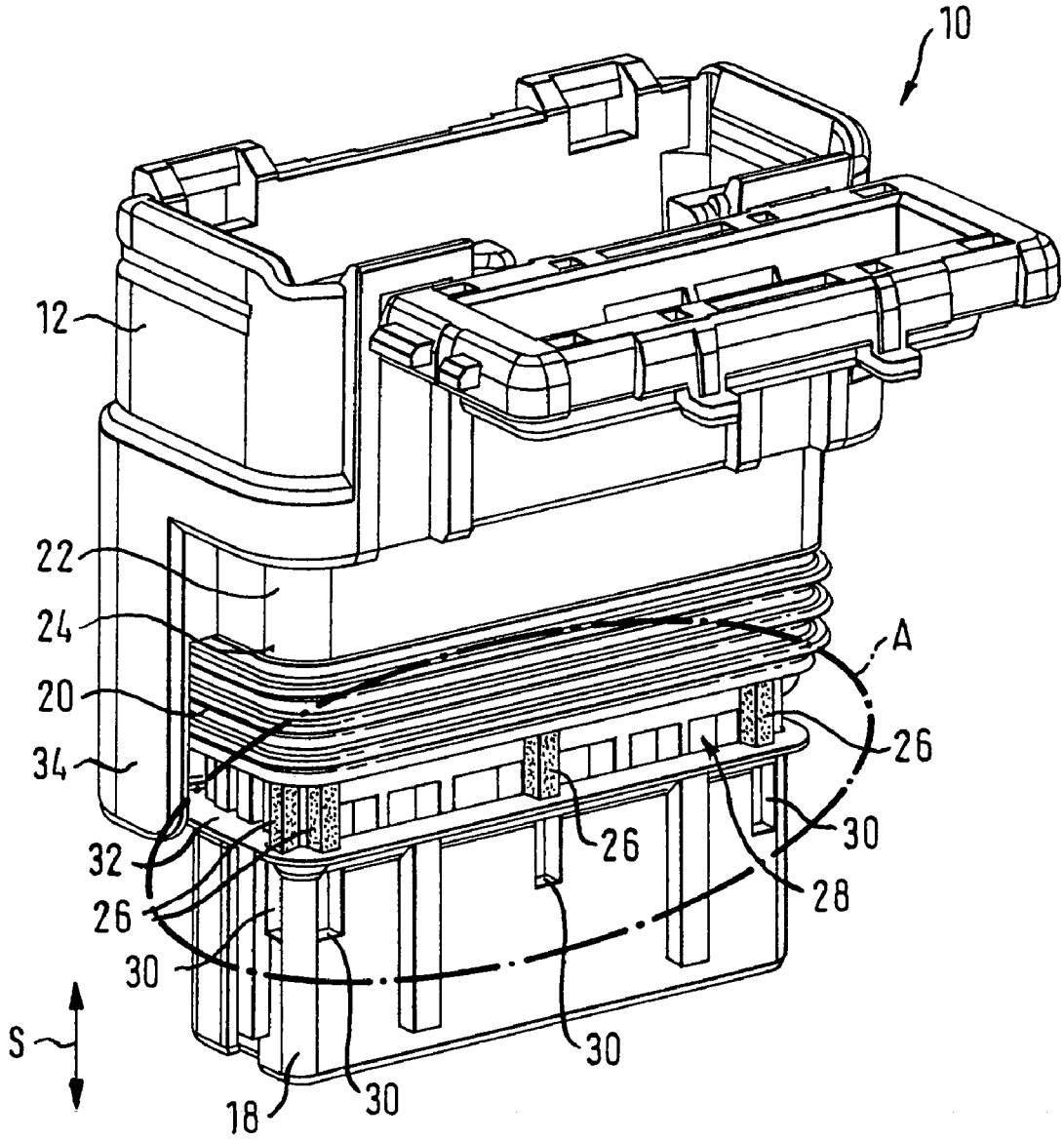
FIG. 1 is a schematic perspective representation of an exemplary embodiment of an electrical plug connector in accordance with the invention provided with guide ribs.

FIG. 1 shows an exemplary embodiment of an electrical plug connector 10 in accordance with the invention in a schematic perspective representation.

This plug connector 10 includes a housing 12 having at least one receiver 14 (see also FIG. 3) for an electrical contact. A plurality of such receivers 14 are provided in the present case.

Figure 3:
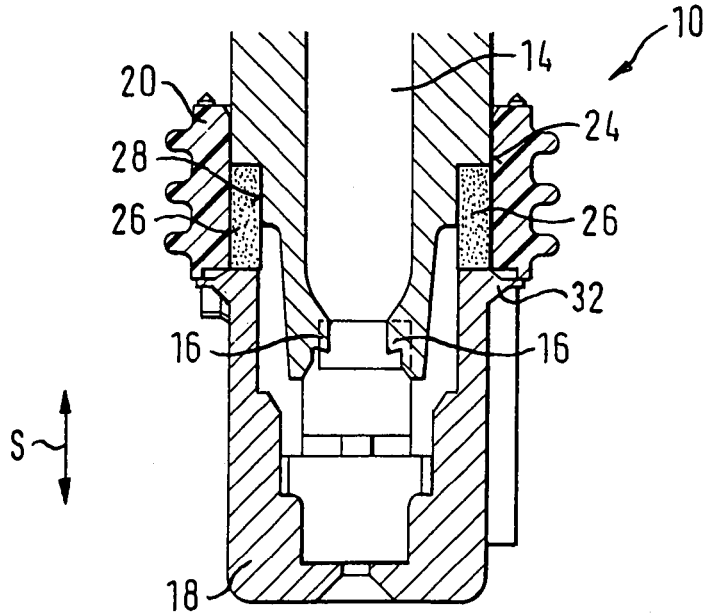
FIG. 3 is a schematic, partly sectioned side view of a part of the electrical plug connector in accordance with the invention of FIG. 1.

The electrical contacts can be latched in the receivers 14 by first latching means 16 (see FIG. 3). These first latching means 16 can, for example, include latch elements such as in particular latching tongues and/or the like.

Figure 2:
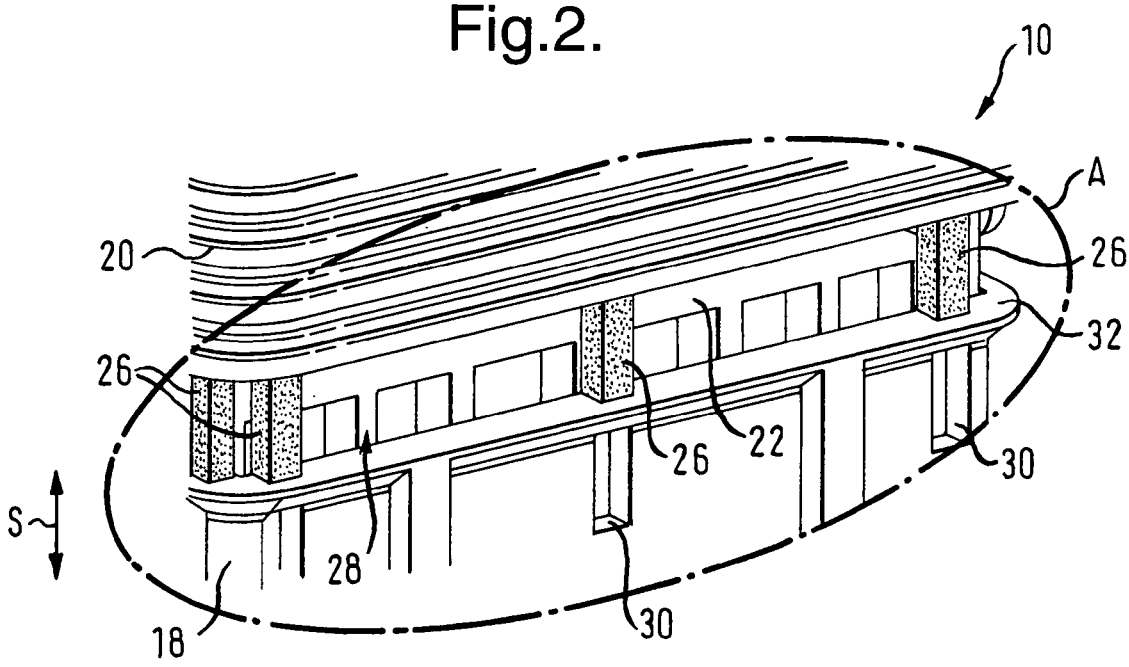
FIG. 2 is an enlarged reproduction of the region of the electrical plug connector in accordance with the invention of FIG. 1 provided with guide ribs.

As can in particular be recognized with reference to FIGS. 1 to 3, the electrical plug connector 10 moreover includes a second latching element 18. This second latching element 18 is movable with respect to the housing 12 from a pre-assembly position, which is shown, for example, in FIGS. 1 to 3 and in which a respective electrical contact can be inserted into the respective receiver 14, into an end position in which the electrical contact is secured in the receiver 14 by the second latching element 18. In the present case, the first latching means 16 in particular formed by latching tongues and/or the like (cf. FIG. 3) are prevented from an outward deflection releasing the first latching by the second latching element 18.

A seal 20 is moreover provided which is mounted on a spigot-like housing section 22 and extends around it.

When considered in the plug-in direction S, guide ribs 26 for the seal 20 are provided between the region or seat 24 (cf. in particular FIG. 3) of the spigot-like housing section 22 designed to receive the seal 20 and the second latching element 18 adopting its pre-assembly position. The seal 20 is also supported by these guide ribs 26 in the critical region 28 between the seating 24 of the seal 20 and the second latching element 18 adopting its pre-assembly position in the event of a possible shift in the direction of the second latching element 18.

Figure 4:
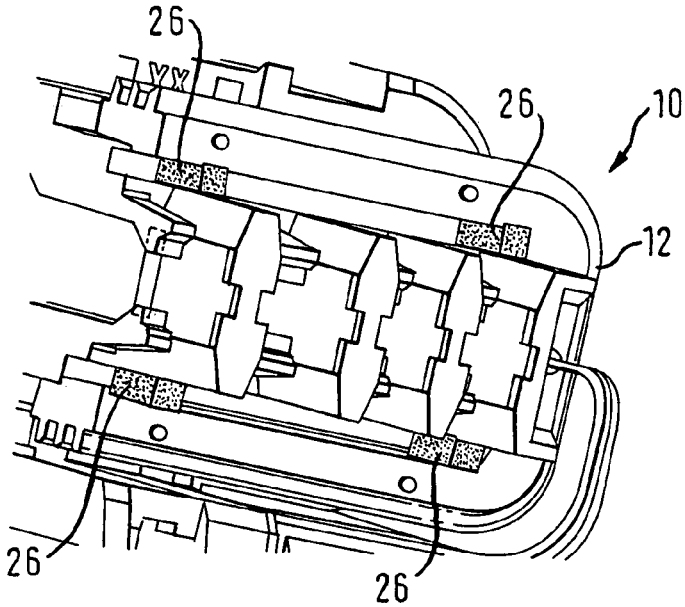
FIG. 4 is a schematic view of the electrical plug connector in accordance with the invention from below, with the second latching element having been omitted for reasons of clarity.

As can in particular be recognized with reference to FIG. 4, the guide ribs 26 are distributed in the peripheral direction such that the seal 22 is also held at least substantially at its pre-tensioned level in the intermediate region 28 in the event of a possible shift (cf. e.g. FIG. 3).

The guide ribs 26 extending in the plug-in direction S can be provided at the housing 12, that is at the spigot-like housing section 22, or also at the second latching element 18, with them being arranged, for example, at the housing 12, that is at the spigot-like housing section 22 in the present case. In the latter case, the second latching element 18 is provided with cut-outs 30 into which the guide ribs 26 enter on a moving of the second latching element 18 into the end position.

The second latching element 18 displaceable between its pre-assembly position and its end position in the plug-in direction S can be provided with a collar 32 at its end facing the seal 20. As can, for example, be recognized with reference to FIG. 3, the seal 20 can optionally stand on this collar 32 of the second latching element 18.

In the present case, the seal 20 extending around the spigot-like housing section 22 is designed like a sleeve and is provided, for example, with three seal ribs. It can in particular consist of an elastomer material.

The spigot-like housing section 22 supporting the seal 20 is arranged inside a peripheral housing collar 34 in the present case (see in particular FIG. 1).

The spacing measured transversely to the plug-in direction S between the seal 20 and the housing collar 34 is expediently smaller than the wall thickness of a housing sleeve associated with a complementary plug connector so that said sleeve can be introduced into the region between the seal 20 and the housing collar 34 on the plugging together of the two connectors and compresses the seal 20 in this process.

The electrical plug connector 10 can generally be provided both as a plug-in part and as a receiver part of the respective plug connector system, with it preferably being provided as a plug-in part, however.

FIG. 2 shows the region A of the electrical plug connector 10 in accordance with the invention of FIG. 1 provided with the guide ribs 26 in an enlarged representation.

FIG. 3 shows a part of the electrical plug connector 10 in accordance with the invention of FIG. 1 in a schematic partly sectioned side view. As already mentioned, the second latching element 18 respectively adopts its pre-assembly position in the representations in accordance with FIGS. 1 to 3.

FIG. 4 shows the electrical plug connector 10 in accordance with the invention from below in a schematic view, with the second latching element having been omitted for reasons of clarity. The guide ribs 26 can correspondingly be recognized which are distributed in the peripheral direction such that the seal 20 is also kept at its pre-tensioned level in the intermediate region 28 (cf. also FIG. 3) in the event of a possible shift.

The seal 20 is therefore also supported in the critical intermediate region 28 in the event of a possible shift in the direction of the second latching element 18 (cf. in particular also FIG. 3 again). A squashing of and damage to the seal 20 is thus precluded on the moving of the second latching element 18 into the end position.

Figure 5:
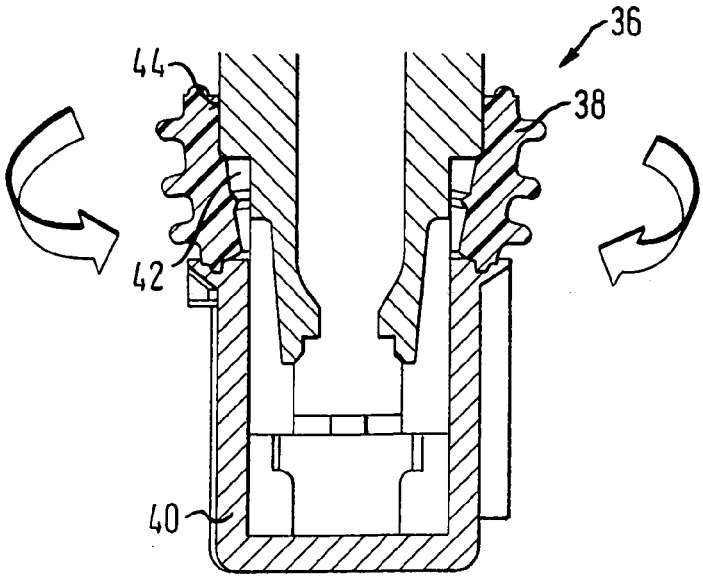
FIG. 5 is a part view comparable with FIG. 3 of a conventional electrical plug connector without guide ribs.

In contrast, a part view comparable with FIG. 3 of a conventional electrical plug connector 36 without guide ribs is shown in FIG. 5. It can be recognized that the seal 40 can fall into the gap 42 between the seal seat 44 and the second latching element 40 adopting its pre-assembly position in the event of a possible shift inwardly in the direction of the second latching element 40. If the second latching element 40 is now shifted into its end position, squashing, damage to or even destruction of the seal 40 occurs, which results in the failure of the electrical plug connector 36.

In contrast, the seal is also supported in the critical intermediate region 28 and is kept at its pre-tensioned level in the electrical plug connector 10 in accordance with the invention (cf. FIGS. 1 to 4) in the event of a possible shift in the direction of the second latching element 18. Squashing of or damage to the seal 20 is thus precluded.

The system in accordance with the invention is self explanatory and the respective plug connectors can be handled without problem and in a simple manner. The respective fitter therefore does not have to make any considerations as to whether the housing seal has slipped or not since it is held at its pre-tensioned level in every case.

The invention claimed is:

1. An electrical plug connector comprising:

a housing having at least one receiver for an electrical contact;

a latching element moveable, with respect to the housing, from a pre-assembly position, in which the electrical contact is permitted-to be inserted into the receiver, to an end position, in which the contact is secured in the receiver by the latching arrangement; and a seal mounted on a spigot-like housing section;

wherein, when considered in a direction of insertion of the electrical contact into the receiver one or more guide ribs for the seal are provided between the spigot-like housing section and the latching element, when adopting its pre-assembly position, said one or more guide ribs being configured to support the seal in an intermediate region in the event of a shift in the position of the latching element.

2. A plug connector in accordance with claim 1, wherein the guide ribs are distributed in a peripheral direction and are configured to maintain the seal is at its pre-tensioned level in the intermediate region in the event of said shift.

3. A plug connector in accordance with claim 1, wherein the guide ribs extend in the direction of insertion.

4. A plug connector in accordance with claim 1, wherein the guide ribs are provided at the spigot-like housing section.

5. A plug connector in accordance with claim 1, wherein the latching element is configured to be displaced between its pre-assembly position and its end position in the direction of insertion.

6. A plug connector in accordance with claim 1, wherein the seal extends around the spigot-like housing section.

7. A plug connector in accordance with claim 1, wherein the spigot-like housing section supporting the seal is arranged inside a peripheral housing collar.

8. A plug connector in accordance with claim 1, wherein the plug connector is configured to be inserted into a mating connector of a plug connector system.

9. A plug connector in accordance with claim 1 wherein the plug connector is configured to receive the insertion of a mating connector of a plug connector system.

10. A plug connector in accordance with claim 4, wherein the latching element is provided with cut-outs configured to receive the guide ribs when the latching element adopts the end position.

11. A plug connector in accordance with claim 7, wherein the spacing between the seal and the housing collar is smaller than the wall thickness of a housing sleeve associated with a complementary plug connector so that said sleeve can be introduced into the region between the seal and the housing collar on the plugging together of the two connectors and compresses the seal.

* * * * *